US007383775B1

(12) United States Patent
Mock, Jr. et al.

(10) Patent No.: US 7,383,775 B1
(45) Date of Patent: Jun. 10, 2008

(54) REACTIVE MUNITION IN A THREE-DIMENSIONALLY RIGID STATE

(75) Inventors: Willis Mock, Jr., Fredericksburg, VA (US); William H. Holt, Fredericksburg, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 247 days.

(21) Appl. No.: 11/326,670

(22) Filed: Dec. 20, 2005

Related U.S. Application Data

(63) Continuation-in-part of application No. 11/223,242, filed on Sep. 6, 2005, now abandoned.

(51) Int. Cl.
*F42B 12/46* (2006.01)

(52) U.S. Cl. ..... 102/363; 102/491; 102/496

(58) Field of Classification Search ..... 102/495, 102/363, 491, 494, 496, 497
See application file for complete search history.

(56) References Cited

U.S. PATENT DOCUMENTS

| | | | | |
|---|---|---|---|---|
| 3,489,088 | A | 1/1970 | Ballmoos et al. | 102/496 |
| 3,961,576 | A | 6/1976 | Montgomery, Jr. | 102/491 |
| 4,096,804 | A | 6/1978 | Bilsbury | 102/364 |
| 4,112,846 | A | 9/1978 | Gilbert et al. | |
| 4,280,409 | A | 7/1981 | Rozner et al. | 102/364 |
| 4,326,901 | A | 4/1982 | Leneveau et al. | |
| 4,362,563 | A | 12/1982 | Stadler et al. | |
| 4,503,776 | A | 3/1985 | Nussbaum et al. | |
| 4,648,323 | A | 3/1987 | Lawther | 102/495 |
| 4,671,181 | A | 6/1987 | Romer et al. | |
| H1048 | H * | 5/1992 | Wilson et al. | 102/496 |
| 5,187,325 | A | 2/1993 | Garvison | 102/509 |
| 5,198,616 | A | 3/1993 | Anderson | |
| 5,214,237 | A | 5/1993 | McArthur | 102/501 |
| 5,291,833 | A | 3/1994 | Boual | |
| 5,313,890 | A | 5/1994 | Cuadros | |
| 5,374,473 | A | 12/1994 | Knox et al. | |
| 5,394,597 | A | 3/1995 | White | 86/55 |
| 5,445,079 | A | 8/1995 | Boual | |
| 5,512,624 | A | 4/1996 | Howard, Jr. et al. | |
| 5,847,313 | A | 12/1998 | Beal | |
| 5,852,256 | A | 12/1998 | Hornig | 102/473 |
| 5,886,293 | A | 3/1999 | Nauflett et al. | 149/109.6 |
| 6,024,021 | A | 2/2000 | Schultz | 102/506 |
| 6,135,028 | A | 10/2000 | Kuhns et al. | |
| 6,293,201 | B1 | 9/2001 | Consaga | 102/363 |
| 6,354,222 | B1 | 3/2002 | Becker et al. | |
| 6,546,838 | B2 | 4/2003 | Zavitsanos et al. | 89/1.13 |
| 6,547,993 | B1 * | 4/2003 | Joshi | 264/3.4 |
| 6,799,518 | B1 | 10/2004 | Williams | |
| 6,846,372 | B1 | 1/2005 | Guirguis | 149/2 |
| 2005/0067072 | A1 | 3/2005 | Vavrick | 149/37 |
| 2005/0087088 | A1 * | 4/2005 | Lacy et al. | 102/495 |
| 2005/0183618 | A1 | 8/2005 | Nechitailo | 102/516 |

* cited by examiner

*Primary Examiner*—Michael J. Carone
*Assistant Examiner*—Gabriel J Klein
(74) *Attorney, Agent, or Firm*—Gerhard W. Thielam, Esq.

(57) ABSTRACT

A reactive munition uses a housing made from a housing in a state that is three-dimensionally rigid. The housing can be made of metal, such as aluminum. A reactive filler, such as powdered polytetrafluoroethylene (PTFE), fills the one or more cavities in the aluminum housing. A jacket encases the housing filled with the reactive filler.

20 Claims, 2 Drawing Sheets

REACTIVE MUNITION IN A THREE-DIMENSIONALLY RIGID STATE

CROSS REFERENCE TO RELATED APPLICATION

The invention is a Continuation-in-Part, claims priority to and incorporates by reference in its entirety U.S. patent application Ser. No. 11/223,242 filed Sep. 6, 2005 titled "Reactive Munition Using Aluminum in a Three-dimensionally Rigid State with a Powdered Polytetrafluorethylene (PTFE) Filling" to Willis Mock, Jr. and William H. Holt and assigned Navy Case 95909.

STATEMENT OF GOVERNMENT INTEREST

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to reactive munitions, and more particularly to a reactive munition that includes a housing in a three-dimensionally rigid state and a reactive material.

BACKGROUND OF THE INVENTION

By their very nature, reactive munitions use two or more reactive components that chemically react with one another upon initiation. The catalyst for such initiation can be a fusing system or target impact. In either case, the reactive components must be kept inert prior to initiation. For small munitions such as pre-formed fragments or bullets, pre-initiation "safing" of the reactive components is a difficult task as the small delivery package limits a munition designer's options in terms of incorporating safety mechanisms therein.

SUMMARY OF THE INVENTION

Described is a reactive munition. The reactive munition is safe to handle, is well-suited for use in a small delivery package such as a pre-formed fragment or bullet, and has reactive components that remain safely inert until target impact.

Other aspects of the present invention will become more obvious hereinafter in the specification and drawings.

In accordance with one implementation of the present invention, a reactive munition is provided that is suitable for fabrication as fragments and bullets. A housing defines at least one cavity therein. The housing can be of aluminum or other appropriate metal in a state that is three-dimensionally rigid. Reactive filler, such as powdered polytetrafluoroethylene (PTFE), fills the one or more cavities. A jacket encases the housing filled with the reactive filler.

DETAILED DESCRIPTION OF THE INVENTION

Figure 1:
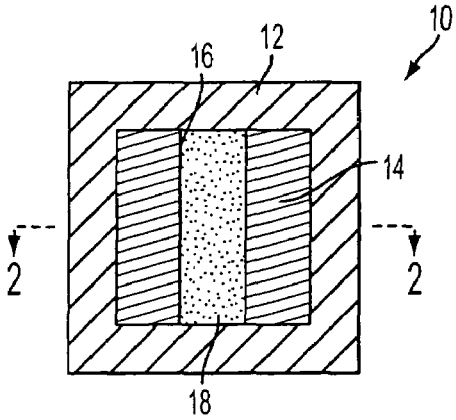
FIG. 1 is a side, cross-sectional view of a reactive munition fragment in accordance with an embodiment of the present invention.

The present invention is a reactive munition that can be fabricated as a fragment or a bullet. For example, referring now to the drawings and more particularly to FIGS. 1 and 2, a fragment in accordance with an embodiment of the present invention is shown and is referenced generally by numeral 10. Typically, fragment 10 will be one of many maintained on a delivery vehicle (not shown) until it is time to dispense same from the delivery vehicle. It is to be understood that the shape of fragment 10 includes other pre-formed shapes and is not limited to the shapes presented herein.

Fragment 10 has an outer casing or jacket 12 with a rigid housing 14 within the jacket 12. The housing 14 may be made of metal, such as aluminum, zirconium, hafnium, tantalum, titanium and magnesium or alloys or composites containing these metals. The housing 14 has a cavity 16 formed therethrough that is filled with a reactive filler 18, such as a powdered or solid form of polytetrafluoroethylene (PTFE), or other fluorinated polymers, copolymers, terpolymers, thermoplastics or epoxies. These filler materials include but are not limited to vinylidene fluoride, polychlorotrifluoroethylene, and other fluorocarbon materials fabricated from fluorocarbon monomers such as hexafluoropropylene, perfluorinated vinyl ether, and chlorotrifluoroethylene.

The metal used for the housing 14 must be in a state that makes the housing 14 a three-dimensionally stable structure. Accordingly, suitable states for the metal include solid, rigid foam and honeycomb. These metals include, but are not limited to, aluminum, zirconium, hafnium, tantalum, titanium and magnesium. Aluminum in these states is safe to handle and work with, as opposed to powdered aluminum, which presents respiratory safety and flammability problems.

The jacket 12 provides the necessary protection for the fragment's reactive components, i.e., aluminum housing 14 and reactive filler 18, prior to a target impact. The jacket 12 also provides the needed material strength to survive acceleration for projection toward and to permit penetration into a target, and the necessary mass for fragment 10 that, when combined with the velocity of fragment 10, provides the needed kinetic energy to pierce a target. Accordingly, suitable materials for the jacket 12 include, but are not limited to for example, metals such as steel, tungsten, hafnium, depleted uranium, aluminum, titanium, magnesium, zirconium, tantalum, etc., or other appropriate jacket materials, including high-density metals. Certain of these materials can enable additional exothermic chemical reactions on impact with the target.

Figure 2:
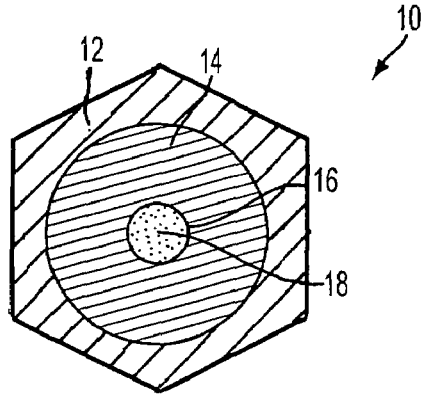
FIG. 2 is a sectional view taken along line 2-2 in FIG. 1.
Figure 4:
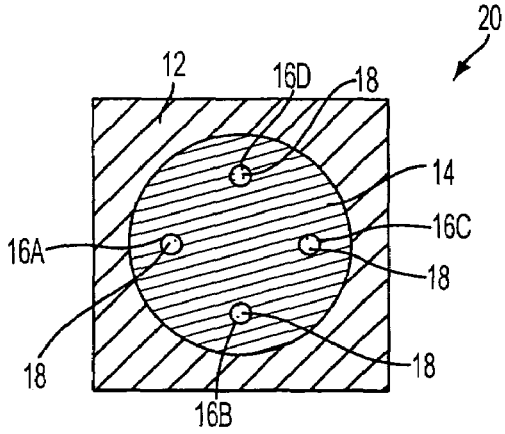
FIG. 4 is a sectional view taken along line 4-4 in FIG. 3.

The cross-sectional shape of the jacket 12 can represent a variety of shapes, such as a hexagon in FIG. 2 and a square in FIG. 4, each with their respective advantages. For example, the hexagonal cross-section shown in FIG. 2 maintains integrity at higher impact velocities than a square cross-section shown in FIG. 4 for the same thickness. Thus, the hexagon shape may provide greater penetration against harder targets, while the square shape would be more suitable for softer targets.

The jacket 12 can be fabricated in a variety of ways without departing from the scope of the present invention. For example, the jacket 12 could be fabricated by drilling, milling or electrical-discharge-machining out a solid piece of metal to accept the housing 14 with reactive filler 18 with the resulting hole in the surface of the jacket 12 being "plugged" with a plug element made from the material used for the jacket 12. Another option would be for the jacket 12 to be cast or pressed and sintered about the housing 14 with reactive filler 18. Note that care must be taken during any casting or pressing and sintering operations to insure that the reactive filler does not melt or react during jacket fabrication.

The cavity 16 of the housing 14 is filled with the reactive filler 18. For powdered PTFE, the powder particles may range in size from approximately 2 to 600 microns in diameter. In general, the density of powdered PTFE 18 is less than that of the solid form of PTFE (i.e., density of solid PTFE is 2.17 grams/cubic centimeter). The solid form of PTFE can be cast and inserted into the cavity 16. Reactive munitions in accordance with the present invention may utilize powdered PTFE densities ranging from approximately 50-99% of the density of solid PTFE. Typically, higher densities are used for higher velocity munitions and lower densities are used for lower velocity munitions.

Figure 3:
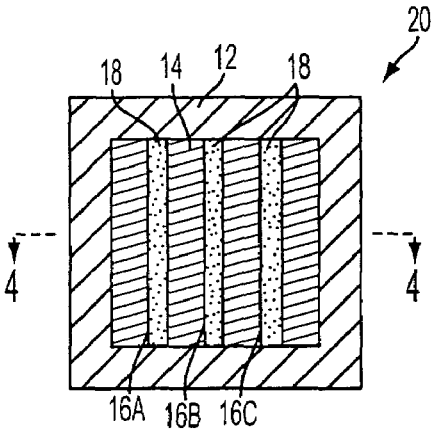
FIG. 3 is a side, cross-sectional view of another embodiment of a reactive munition fragment.
Figure 5:
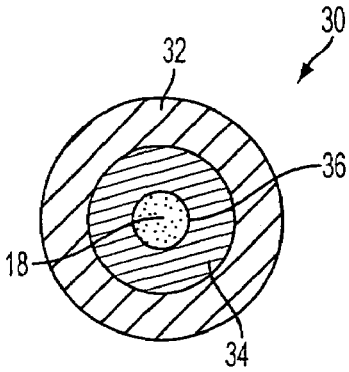
FIG. 5 is a sectional view of another embodiment of the present invention where the filler material is completely encased in the housing.
Figure 6:
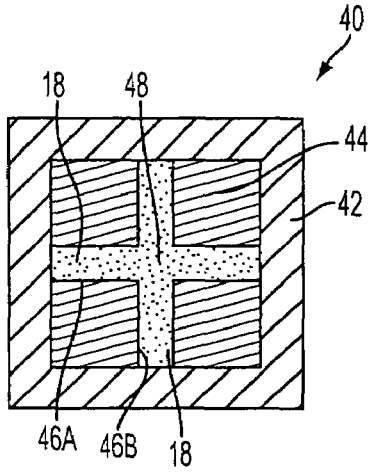
FIG. 6 is a side, cross-sectional view of another embodiment of a reactive munition fragment in which the cubed housing has three orthogonal cavities formed therein.

The shape, number and/or configuration of cavities in the fragment's housing may vary. For example, FIGS. 3 and 4 illustrate a fragment 20 having a number of cavities 16A-16D extending through the housing 14 with reactive filler 18 filling each of the cavities. In FIG. 5, a fragment 30 illustrates a spherical or cylindrical fragment defined by an outer spherical or cylindrical jacket 32. The fragment 30 has a single cavity 36 that, rather than extending through a metal housing 34, is fully encased by the housing 34 so that the reactive filler 18 is also fully encased within the housing 34. Still another fragment embodiment is illustrated in FIG. 6 where a fragment 40 has a cubed metal housing 44 encased in a jacket 42. The housing 44 has three orthogonally-oriented cavities extending therethrough that meet in the center 48 of the housing 44. More specifically, in the illustration, two of the three orthogonal cavities are indicated by 46A and 46B with reactive filler 18 filling the cavities as in the previous embodiments.

Figure 7:
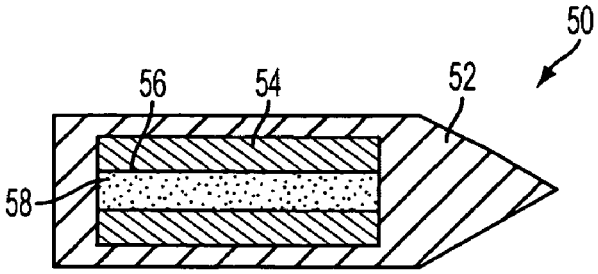
FIG. 7 is a side, cross-sectional view of a bullet-shaped reactive munition in accordance with another embodiment of the present invention.
Figure 8:
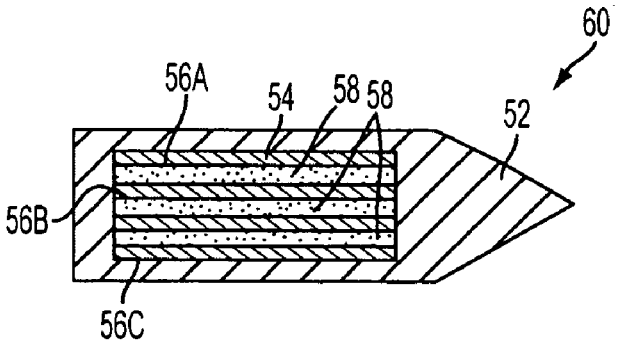
FIG. 8 is a side, cross-sectional view of another embodiment of a bullet-shaped reactive munition in accordance with the present invention.

The present invention is not limited to use in the construction of fragments. For example, as illustrated in FIGS. 7 and 8, the novel aspects of the present invention can be applied to bullets. In FIG. 7, a bullet 50 has a bullet-shaped jacket 52 (e.g., suitable materials for jacket 52 include, for example, metals such as steel, tungsten, hafnium, aluminum, titanium, magnesium, zirconium, tantalum, depleted uranium, alloys or composites containing these metals, etc., or other appropriate jacket materials) that encase a housing 54 (e.g., a metal in solid, rigid foam and honeycomb states that include, but are not limited to, aluminum, zirconium, hafnium, tantalum, titanium and magnesium, etc.) having a cavity 56 formed therethrough. A reactive filler 58, such as powdered PTFE using particle sizes and densities from the ranges defined previously, fills cavity 56. In FIG. 8, a bullet 60 utilizes multiple cavities (e.g., cavities 56A, 56B and 56C) in the housing 54.

Figure 9:
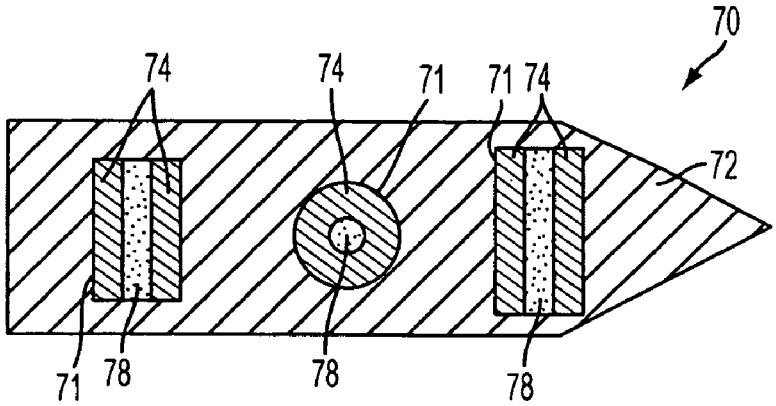
FIG. 9 a side, cross-sectional view of another bullet-shaped reactive munition in accordance with another embodiment of the present invention.

Other bullet constructions could be used without departing from the scope of the present invention. For example, if the integrity of the bullet jacket during bullet launch is of concern (i.e., as may be the case for the axial holes formed in bullets 50 and 60), a construction such as that shown in FIG. 9 could be used. More specifically, a bullet 70 has a plurality of radial holes 71 formed in bullet jacket 72. In general, radial holes 71 are distributed about and/or along bullet jacket 72 in order to achieve a desired balance. Each of radial holes 71 is filled with a housing 74 with reactive filler 78 similar to the previously-described embodiments. The number of radial holes 71 and the size, shape and placement of radial holes 71 are not limitations of the present invention.

The results of pressure chamber impact experiments of the present invention indicate enhanced damage for solid aluminum with powdered PTFE filler. Further, gaseous products collected during the experiments yielded carbon monoxide, carbon dioxide, the PTFE monomer, and other fluorocarbon compounds, while post-impact analysis of the impact areas yielded solid residue indicating the presence of solid aluminum trifluoride and solid aluminum oxide. These results indicate that the enhanced damage was the result of the chemical reaction of: (i) the aluminum housing, (ii) the powdered PTFE, and (iii) the surrounding atmospheric oxygen when the oxygen comes into contact with the aluminum and powdered PTFE that reach high temperatures upon target impact. However, the solid aluminum and PTFE powder are inert with respect to one another prior to target impact. This means that no additional safety mechanisms need be incorporated into the reactive munition, thereby simplifying construction of a reactive munition and minimizing costs associated therewith. Further, solid aluminum is easy and safe to work with—as opposed to powdered metals typically used in reactive munitions.

Although the invention has been described relative to specific embodiments thereof, there are numerous variations and modifications that will be readily apparent to those skilled in the art in light of the above teachings. For example, based on experimental results of fragments/bullets constructed in accordance with the present invention, alternate metals other than aluminum may be used. That is, when higher density munitions are required, aluminum may be replaced with a higher density metal, such as zirconium (density=6.52 grams/cubic centimeter), hafnium (density=13.3 grams/cubic centimeter), tantalum (density=16.4 grams/cubic centimeter), etc. For lower density munitions, it may be possible to replace aluminum with a metal such as magnesium (density=1.74 grams/cubic centimeter). It is therefore to be understood that, within the scope of the appended claims, the invention may be practiced other than as specifically described.

What is claimed as new and desired to be secured by Letters Patent of the United States is:

1. A reactive sub-munition fragment in a warhead, said sub-munition fragment comprising:

a housing defining at least one cavity therein, said housing being three-dimensionally rigid;

reactive filler filling said at least one cavity, said reactive filler being non-metal having solid or powder form; and a protective jacket completely encasing said housing so-filled with said reactive filler.

2. The reactive fragment as recited in claim 1, wherein said housing is made from at least one of aluminum, zirconium, hafnium, tantalum, titanium and magnesium.

3. The reactive fragment as recited in claim 1, wherein said housing is made from metal having a state selected from the group consisting of a solid, a rigid foam and a honeycomb.

4. The reactive fragment as recited in claim 1, wherein said at least one cavity comprises a single contiguous cavity.

5. The reactive fragment as recited in claim 1, wherein said at least one cavity comprises a plurality of cavities.

6. The reactive fragment as recited in claim 1, wherein said at least one cavity extends through said housing.

7. The reactive fragment as recited in claim 1, wherein said reactive filler is selected from the group consisting of fluorinated polymers, copolymers, terpolymers, thermoplastics and epoxies, wherein said epoxies are selected from the group consisting of polytetrafluorethylene (PTFE), vinylidene fluoride, polychlorotrifluoroethylene, and other fluorocarbon materials fabricated from a fluorocarbon monomer, wherein said fluorocarbon monomer is selected from the group consisting of hexafluoropropylene, perfluorinated vinyl ether, and chlorotrifluoroethylene.

8. The reactive fragment as recited in claim 1, wherein said reactive filler is a powdered PTFE that comprises particles having sizes in the range of approximately 2-600 microns.

9. The fragment as recited in claim 1, wherein said protective jacket comprises a metal selected from the group consisting of steel, tungsten, hafnium, aluminum, titanium, magnesium, zirconium, tantalum and depleted uranium.

10. The reactive fragment as recited in claim 1, wherein said protective jacket has at least one cross-section that forms one of a square and a hexagon.

11. The reactive fragment as recited in claim 1, wherein said protective jacket has an outer shape selected from the group consisting of a shaped fragment and a bullet.

12. A reactive sub-munition fragment in a warhead, said sub-munition fragment comprising:

an aluminum housing defining at least one cavity therein;

powdered polytetrafluoroethylene (PTFE) filling said at least one cavity; and a protective jacket completely encasing said housing so-filled with said powdered PTFE.

13. The reactive fragment as recited in claim 12, wherein said PTFE filling has a density that is in the range of approximately 1.03-2.15 grams per cubic centimeter.

14. The reactive fragment as recited in claim 12, wherein said at least one cavity comprises a single contiguous cavity.

15. The reactive fragment as recited in claim 12, wherein said at least one cavity comprises a plurality of cavities.

16. The reactive fragment as recited in claim 12, wherein said at least one cavity extends through said housing.

17. The reactive fragment as recited in claim 12, wherein said powdered PTFE comprises particles having sizes in the range of approximately 2-to-600 microns.

18. The reactive fragment as recited in claim 12, wherein said protective jacket comprises a metal selected from the group consisting of steel, tungsten, hafnium, aluminum, titanium, magnesium, zirconium, tantalum and depleted uranium.

19. The reactive fragment as recited in claim 12, wherein said protective jacket has at least one cross-section that forms one of a square and a hexagon.

20. The reactive fragment as recited in claim 12, wherein said protective jacket has an outer shape selected from the group consisting of a shaped fragment and a bullet.

* * * * *